US007951020B2

(12) United States Patent
Castor et al.

(10) Patent No.: US 7,951,020 B2
(45) Date of Patent: May 31, 2011

(54) DEVICE FOR SHOULDER AND ARM WARM UP EXERCISING AND METHODS FOR USING SAME

(76) Inventors: Craig Castor, Venetia, PA (US); Eric Cardwell, Pittsburgh, PA (US)

( * ) Notice: Subject to any disclaimer, the term of this patent is extended or adjusted under 35 U.S.C. 154(b) by 135 days.

(21) Appl. No.: 12/287,982

(22) Filed: Oct. 15, 2008

(65) Prior Publication Data

US 2010/0093470 A1 Apr. 15, 2010

(51) Int. Cl.
*A63B 69/00* (2006.01)
*A63B 21/00* (2006.01)

(52) U.S. Cl. ..... 473/458; 473/451; 482/44; 482/108

(58) Field of Classification Search ..... 473/451, 473/458, 596, 422; 215/275, 396; 482/108, 482/140, 44, 93; D21/679, 682; D7/311
See application file for complete search history.

(56) References Cited

U.S. PATENT DOCUMENTS 1,953,633 A * 4/1934 Ramos ..... 215/275
3,334,899 A * 8/1967 Bosko et al. ..... 482/108
3,414,260 A * 12/1968 Gust ..... 482/109
3,652,085 A 3/1972 Cole
3,679,204 A 7/1972 Busby
3,888,482 A 6/1975 Starrett et al.
4,029,312 A * 6/1977 Wright ..... 482/108
4,627,618 A * 12/1986 Schwartz ..... 482/108
4,651,526 A * 3/1987 Mann et al. ..... 60/456
4,695,051 A 9/1987 Jenison
4,703,927 A * 11/1987 Hanzlik ..... 482/74
4,720,098 A * 1/1988 Gordon ..... 482/108
D297,961 S 10/1988 Egger
D299,153 S 12/1988 Hall
4,846,471 A 7/1989 Haysom
4,881,736 A * 11/1989 Fox ..... 473/417
4,913,422 A 4/1990 Elmore et al.
4,974,836 A 12/1990 Hirsch
4,984,789 A 1/1991 Socci
5,092,588 A * 3/1992 DeLuca ..... 482/44
D329,539 S * 9/1992 Klien et al. ..... D3/202
5,158,517 A 10/1992 Steggert
D339,839 S 9/1993 Day
5,250,016 A 10/1993 Higgins
D343,660 S 1/1994 Hwang
5,336,140 A 8/1994 LeBlond
5,348,292 A 9/1994 Norman, Sr.
D359,090 S 6/1995 Van Der Hoeven
5,431,615 A * 7/1995 Correll ..... 482/108
5,445,587 A * 8/1995 Brown ..... 482/108
5,452,889 A * 9/1995 Lewinski et al. ..... 473/519
5,713,805 A 2/1998 Scher et al.

(Continued)

*Primary Examiner* — Gene Kim
*Assistant Examiner* — M Chambers
(74) *Attorney, Agent, or Firm* — Gary P. Topolosky

(57) ABSTRACT

A device for throwing and swinging sports comprises a semi-transparent bottle into which varying amounts of a media may be added. One embodiment of that bottle is generally concave in cross-section for better gripping and includes markings on at least one side for showing different filling levels. A gripping element extends from a middle of the bottle sidewall. One such element is a baseball, real or simulated. Other embodiments include a softball, a football-sized element and/or a racket handle. In order to assist the user with timed workouts, an optional cap may include a built-in clock for signaling when to switch from one exercise to another. Methods for exercising with this device are also disclosed.

13 Claims, 11 Drawing Sheets

U.S. PATENT DOCUMENTS 5,967,952 A * 10/1999 Bronstein et al. ..... 482/111
6,024,660 A 2/2000 Romanick
6,312,364 B1 * 11/2001 Selsam ..... 482/93
6,322,462 B1 11/2001 Kafer
6,413,196 B1 7/2002 Crowson
6,565,491 B1 5/2003 Thompson et al.
2006/0135291 A1 6/2006 Biegen
2006/0223682 A1 10/2006 Joe
2007/0049135 A1 3/2007 Allen et al.

* cited by examiner

DEVICE FOR SHOULDER AND ARM WARM UP EXERCISING AND METHODS FOR USING SAME

FIELD OF THE INVENTION

The present invention relates to an exercise device for athletes of throwing and swinging sports. More particularly, this invention relates to an athletic training and strengthening device for promoting an athlete's shoulder and arm muscle strength via simulated throwing or swinging motions. This invention further relates to a device for exercising certain muscles when grasped with one hand and shaken or oscillated back and forth. The invention addresses methods for athletes to perform active warm-up, deceleration, stretch and/or progressive resistive exercises with such devices.

BACKGROUND OF THE INVENTION

Athletic devices for developing throwing or swinging techniques and strength can be grouped into two general categories. The first covers strengthening devices that use a resistive force for strengthening those muscles used in the motion of swinging (e.g., a tennis racket) or throwing a ball such as a baseball (e.g., pitching). In the second category are training devices for teaching a preferred technique of swinging (e.g., volley, serve) or throwing (e.g., a curveball, slider, etc.) without specifically targeting muscle development.

For baseball pitching (and throwing to a lesser extent), some representative devices in the first category include a non-elastic cord or rope that passes over a pulley secured to a fixed point. One end of the cord/rope attaches to a handle or ball while the other end connects to an inertial force or weighted object. The handle or ball is accelerated by being propelled through the air with the transfer of energy from the athlete's throwing hand. The opposing resistive force that is produced can strengthen some of the muscles an athlete uses in pitching a baseball. Examples of such devices are disclosed in U.S. Pat. Nos. 4,974,836, 5,158,517, 6,413,196, and 6,565,491.

Other devices in the first category produce a resistive force by stretching elastic material. Typically, those devices include an elastic cord with one end tethered to a grounded surface. At the opposite cord end is a handle or ball that the athlete pulls to produce a resistive force for strengthening some of the muscles used when pitching a baseball. Examples of such devices are disclosed in U.S. Pat. Nos. 3,652,085 and 4,846,471. These devices may develop some degree of muscle strengthening in the hand, arm and shoulders. But, they not specifically target the development of muscle coordination or conditioning typically required to properly pitch or throw. By varying degrees, the aforementioned limitations of these types of devices produce insufficient conditioning and coordination, or muscle development, to fully develop an athlete's capacity to pitch properly.

Numerous devices in the second category use a variety of methods to teach the proper techniques and mechanics of throwing a baseball. The devices of U.S. Pat. Nos. 3,888,482, 4,984,789, 5,348,292 and 6,322,462 are each intended to train pitchers to use correct arm and elbow action when throwing a baseball. Generally, such devices do not disclose methods for strengthening or conditioning the athlete while teaching proper throwing techniques and mechanics.

In Biegen Published Application No. 2006-135291, there is shown a foamed structure with aerodynamic drag designed to train and strengthen an athlete's throwing motions. A baseball sized attachment extends from one end of that structure with a flexible strap. Alternate shapes are shown in FIGS. 5 through 7 of that reference.

Still other prior art devices include: the Y-shaped tether system of Scher et al. U.S. Pat. No. 5,713,805; the weighted tube screwed into one end of a "sports" ball per Romanick U.S. Pat. No. 6,024,660; the ball throwing rehab/training device of Higgins U.S. Pat. No. 5,250,016 that uses several elastic band harnesses and a ball held on a frame; and their early predecessor, the weighted whirling exercise device of Busby U.S. Pat. No. 3,679,204.

There also exists several design patents pertaining to water bottle shaped exercising apparatus. See, for example, Van Der Hoeven, U.S. Pat. No. D359,090 with its contoured handle shape. In FIGS. 4 and 5 of Hwang U.S. Pat. No. D343,660, that bottle appears somewhat concave though in a different context. Still other handled shapes were design patent protected in Hall U.S. Pat. No. D299,153 and Egger U.S. Pat. No. D297,961. The aspect of a separate handle was eliminated by the aquatic exercise bottle shape in Day U.S. Pat. No. D339,839.

Water weighted devices are also the subject of Gordon U.S. Pat. No. 4,720,098. Therein, a handheld, dumbbell-shaped weight exerciser includes a drink reservoir in its central section. Contrast that with the liquid fillable dumbbell of Brown U.S. Pat. No. 5,445,587 having an alternate weight indicator means per FIG. 5. The primary focus of Jenison U.S. Pat. No. 4,695,051 was a collapsible, dumbbell. An alternate shaped, cylindrical version of same, with an integral handle, is shown in FIGS. 4 through 8.

Two published, pending applications, Allen et al. U.S. Published Application No. 2007-49135 and Joe U.S. Published Application No. 2006-223682, address cylindrically shaped, exercise devices with the former device accommodating granular material therein for rhythmic sound-making. By contrast, the Joe device has an elongated weight (item 17) tethered between tube ends.

A barbell with hollow, interlocking weights is the subject of Elmore et al. U.S. Pat. No. 4,913,422. And finally, some degree of linear "deceleration" for hand exercising is shown and described in LeBlond U.S. Pat. No. 5,336,140.

SUMMARY OF THE INVENTION

Typical devices for pitching or throwing or do not always combine training, strengthening and conditioning. It is therefore an object of this invention to combine the ability to strengthen, coordinate and condition all the specific muscle sets for an athlete to throw or swing over his/her shoulder.

Another object is to provide a training and strengthening device for pitching with the resistive force of a typical pitching motion while aiding in strength, coordination and conditioning of the specific muscle sets required for same.

Yet another object is to provide a device for pitching or throwing that does not need to be tethered, anchored or affixed to any grounded structure. Such a device is small enough to be hand-held and remain in the athlete's hand during use. As such, this training and strengthening device may be used either indoors or outdoors.

Still another object of this invention is to provide a device for deceleration exercising that does not require the participation of anyone other than the athlete. Preferred embodiments of this device include a built-in timer for such purposes.

It is another principal object of this invention to provide a device for throwing a ball and/or swinging a racket while minimizing wear and tear to the athlete's muscular-skeletal structure. Ideally, this device allows for repetitive, oscillating workouts to improve the cardiovascular stamina of an athlete. It is also suitable several key muscular rehabilitation exercises.

These and other objects and advantages are attained with an exercise device that comprises a semi-transparent bottle into which varying amounts of a media may be added. One embodiment of that bottle has a generally concave cross-section for better gripping with markings on at least one side to show different media filling levels. A gripping element is fixedly attached to extend from a middle of the bottle. One such element is an actual baseball, with typical stitching. Another embodiment uses a rubberized, practice ball sized to simulate the general weight and shape of a baseball. Still other embodiments include a softball (not shown), a football-sized gripping element and an element resembling a tennis racket handle. When the gripping element attaches to only one side of the bottle, rather than completely through, the bottle may be used to store drinkable liquids such as water or the like. In order to assist the user with timed workouts, an optional cap to this bottle may include a built-in clock for signaling when to switch from one exercise to another. An optional lid handle loop also assists with device carrying and storage.

The foregoing device may be used to exercise different muscles by grasping and simulating athletic throwing and swinging. Preferred embodiments include at least one element for gripping, holding, or otherwise connecting with an individual's hand thereby enabling exercise of the athlete's shoulder and arm muscles while simulating desired throwing and/or swinging motions.

One embodiment of this invention provides a training and strengthening device for baseball pitching and throwing. The device includes a baseball gripping element, or a gripping element alternative that is substantially the same size as a baseball. Said alternative may be adapted from a rubberized practice ball. The typical regulation-size ball would have standard stitching. The alternative, "practice" baseball grip would not necessarily have stitching, either real or simulated.

The device requires no one other than the athlete to use. It remains secure in the athlete's hand during use, thereby allowing a fast-paced, repetitive workout. By reducing the typical levels of strain generated from rapid acceleration and deceleration characteristics of pitching, this device is ideal for rehabilitation purposes. The device is portable, need not be tethered to any grounding surface, and can be used safely and easily both indoors and outdoors. This device is relatively simple in design, yet economical to manufacture and use.

When used for deceleration exercising, the device may be grasped in one hand at a centrally-located gripping element, before being shaken back and forth. Such oscillation, while grasping the gripping element, causes muscles on opposite sides of a one's arm to reciprocally contract and relax numerous times. That type of exercising strengthens muscles, increases power and quickness in muscle contraction and relaxation, and increases muscle endurance. It also improves coordination between muscles on the opposite sides of one's arm, balances muscle tone between muscles on opposite arm sides and promotes proximal stability in the upper arm for distal mobility.

BRIEF DESCRIPTION OF THE DRAWINGS

The structure, operation, and methodology of the invention, together with other objects and advantages thereof, may be better understood by reading the detailed description in conjunction with the accompanying drawings in which.

DETAILED DESCRIPTION OF PREFERRED EMBODIMENTS

Figure 1:
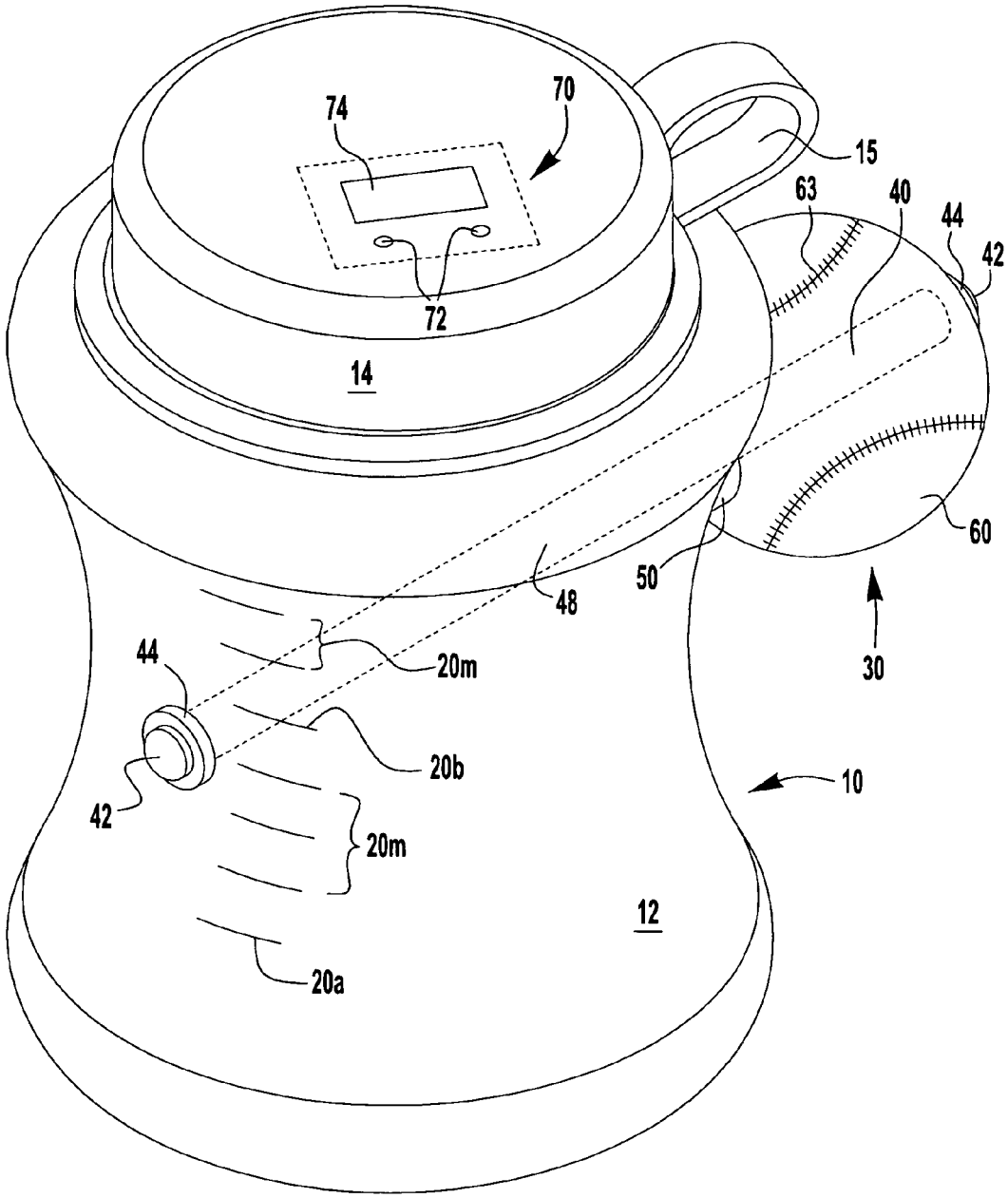
FIG. 1 is a perspective view of one embodiment of the invention adapted for baseball pitch exercising.

Referring to FIGS. 1 through 4, there is shown one embodiment of athletic training and strengthening device, generally 10, per the present invention. Device 10 is particularly adapted for pitching or throwing baseballs, and comprises two major components. The first component is a bottle for holding varying amounts of a media, preferably liquid media, such as water or the like. As shown, bottle has a main body component 12 and a lid component 14. The lid component 14 in these FIGURES is a screw on type for mating with a wide mouth opening on the body component 12. In these views, lid component 14 has a collar or flange extension 15 for fitting over the mouth of body component 12 before screwing onto the threads T of that body mouth. Still other lid and body combinations are possible with the present invention, however, including small mouthed varieties, snap on lids and/or lids with pull open valves.

On a preferred basis, body component 12 is substantially semi-transparent for visually illustrating the amount of media included in same. Body component may be completely clear, or made from a colored polymer like a polycarbonate, an HDPE plastic, an LDPE, a polypropylene and/or a PET plastic resin. Alternately, an opaque body component may be made with a transparent or semi-transparent window along one side for indicating the amount of media therein.

Body component 12 includes at least two side markings 20*a* and 20*b*. In a typical body component for holding about 12-16 ounces (0.75-1 lb.) of liquid media, the first marking indicator (element 20*a*) should show a first fill level suitable for warm up exercising (or an indicator for about 1-1.5 lbs. of media). The second indicator (element 20*b*) should show the media addition levels for progressive resistance exercising (sometimes called "PRE"). That can range between 2-3 lbs. of media within body component 12. Obviously, multiple markings ("20*m*") are also possible with these body components to show more than two media levels.

Figure 3:
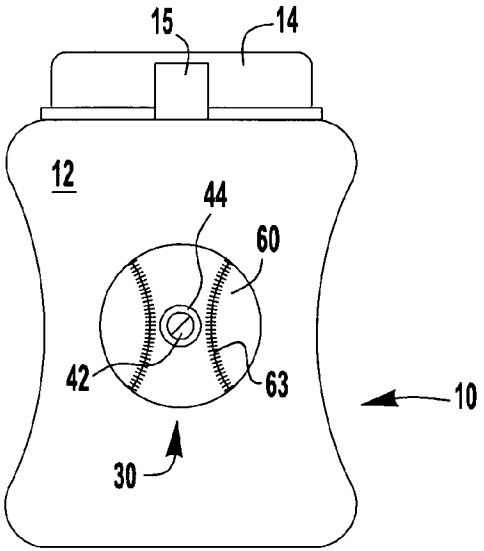
FIG. 3 is a front plan view of the FIG. 1 device.
Figure 2:
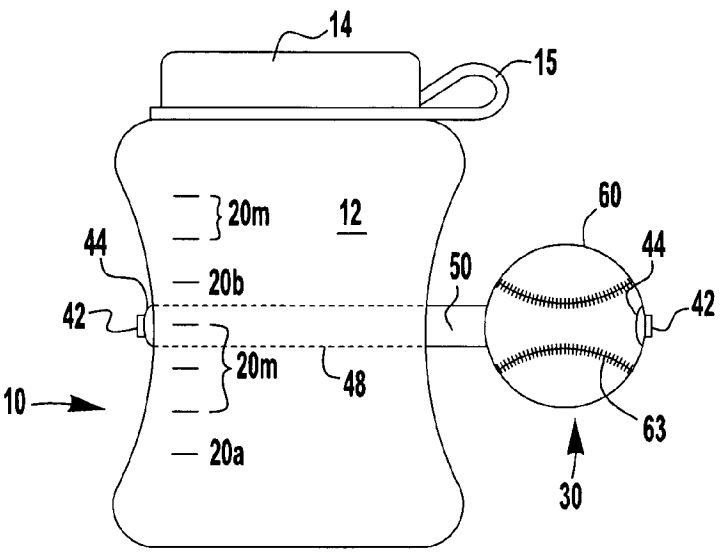
FIG. 2 is a left side plan view of the device from FIG. 1, the right side view being a mirror image of same.

In FIGS. 1 through 3, one embodiment shape for body component 12 is more evident. That shape would be one with a substantially concave cross-section. Such a shape would enable an athlete to grip the whole of body component 12 by wrapping his/her fingers about that body component as an alternative to exercising with the gripping element described hereinafter.

The second main component for device 10 is a gripping element, generally 30, that extends a spaced distance from one side of body component 12. At a minimum, gripping element 30 should be spaced about 1 to 1.5 inches from the bottle body, or a sufficient distance for the athlete's fingers to grasp the gripping element and swing it about during exercising. Preferably, gripping element 30 extends outwardly from an intermediate point or substantially midway along the length (or relative height) of body component 12 for better balancing the device during shoulder and arm exercising therewith.

Figure 5A:
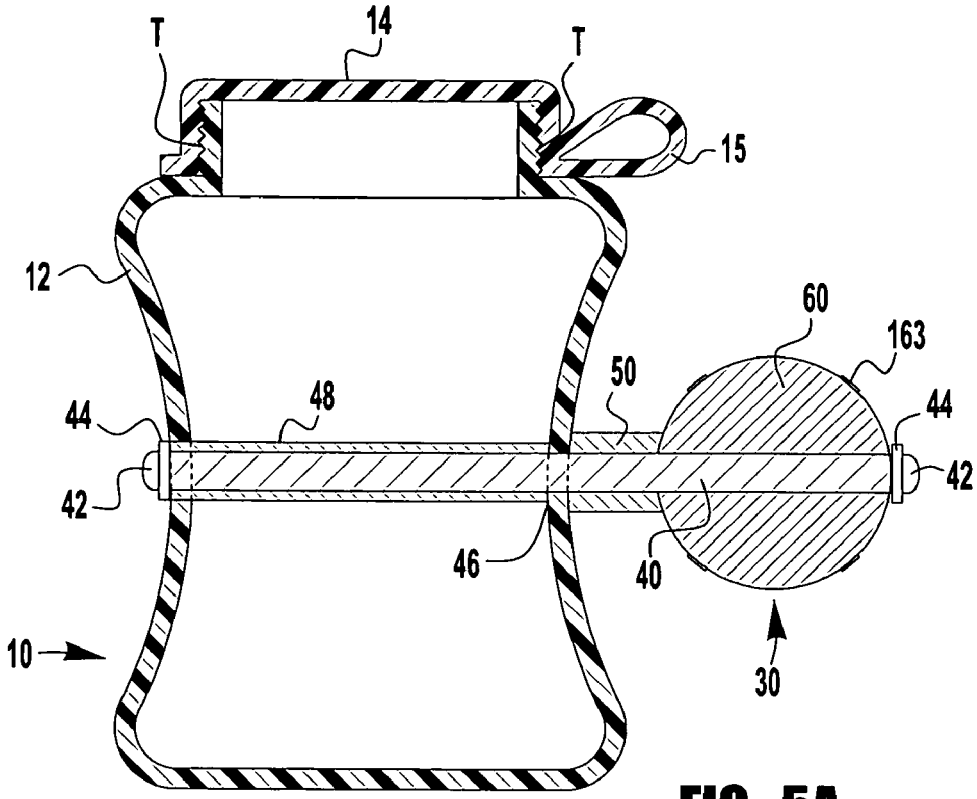
FIG. 5A is a left side, cross-sectional view of the device from FIG. 4 taken along lines 5A-5A.

In a first embodiment, gripping element 30 is fixedly attached to the bottle, or more specifically body component 12. Referring to FIGS. 1, 2 and 5A (the latter being a cross-sectional view midway through device 10), there is shown a first means for more permanently attaching gripping element 30 to body component 12. It includes an elongated bolt 40, having a first bolt head 42 and watertight washer 44, through an opposed sidewall of the gripping element proper. That same bolt 40 passes through the inside of body component 12 before exiting through hole 46 in the opposite sidewall running substantially parallel to the lowermost bottle base. One or more gaskets or washers (element 44, again) may be positioned on the bolt stem before a spacer element 50 is added. That spacer element 50 may be made from metal, plastic or combinations of materials.

Adjacent spacer element 50 is the exercise grip 60 through which bolt 40 further extends before terminating with another washer 44 and second bolt head 42. Should it be desirable to use the body of device 10 for transporting consumable liquid media, the main body of bolt 40 within the interior of body component 12 may be passed through an acceptable sleeve element 48 like one made from the same polymer material used to make body component 12 and/or lid component 14. See especially, FIG. 5A for a better view of sleeve element 48.

In this first embodiment, the exercise grip 60 is a standard, regulation size baseball with stitching 63. To a lesser degree, a softball sized grip may be substituted for the aforementioned baseball but only for throwing practice since a typical softball is pitched underhanded rather than overhand.

Figure 4:
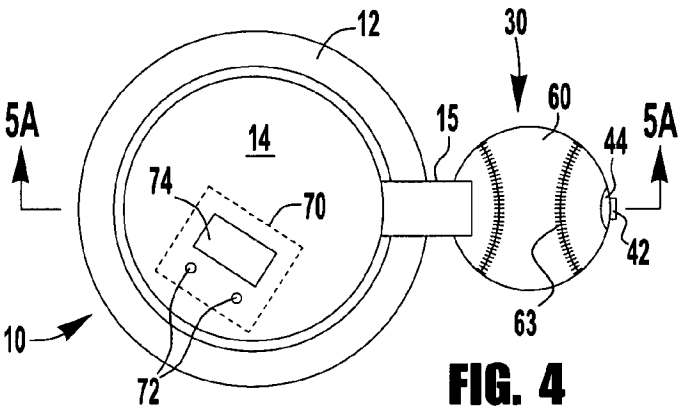
FIG. 4 is a top plan view of the same device showing its optional lid timer.

In FIGS. 1 and 4, there is shown an optional timer 70 built into the lid or cap component 14. That timer 70 would have two or more buttons 72 for setting up conditions for timing exercises with the device over a predetermined length of time per exercise and a resetting of the timer proper. Also as shown, timer 70 includes a digital time display element 74.

Figure 10A:
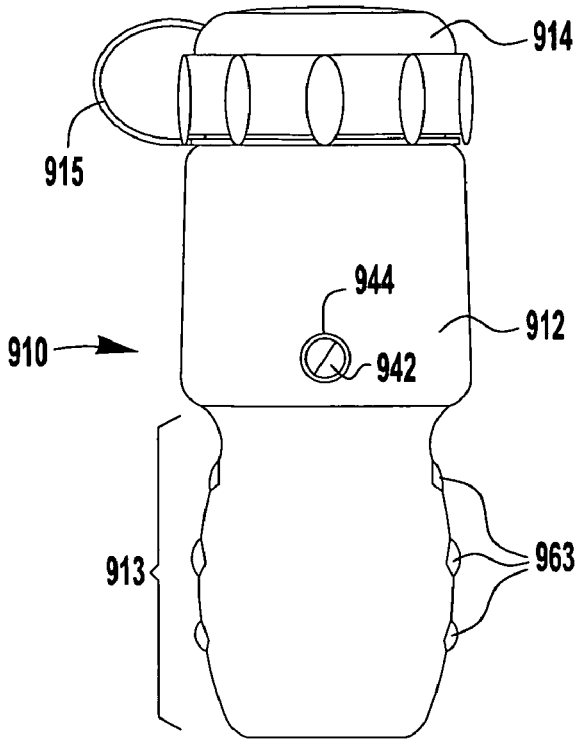
FIG. 10A is a rear plan view of a eighth alternate embodiment with a football sized grip and simulated football laces on opposite sides of its base.
Figure 10B:
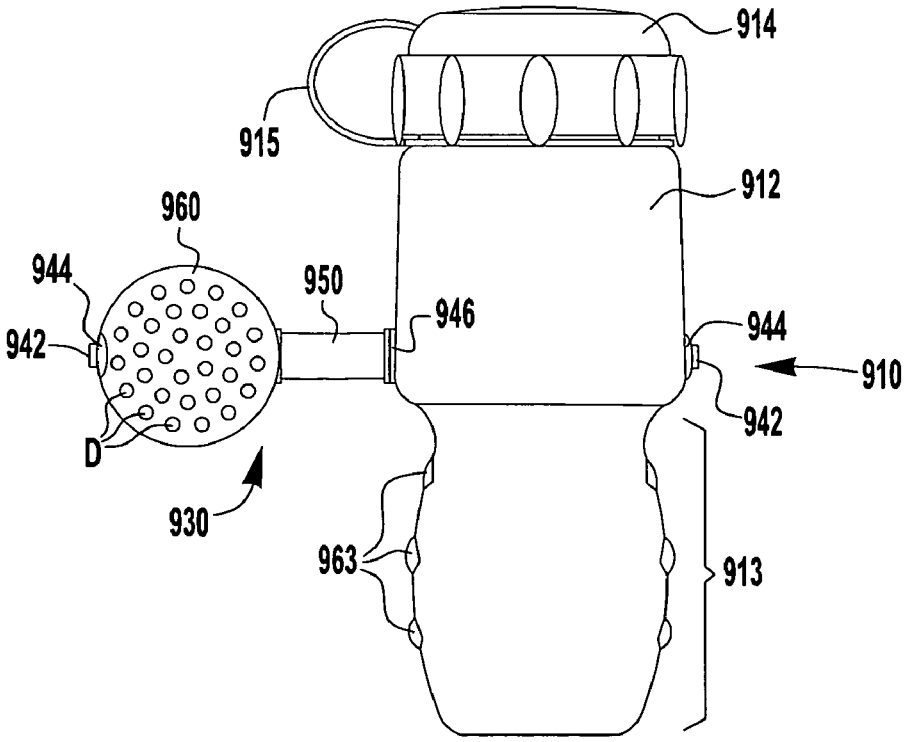
FIG. 10B is a right side, plan view of the FIG. 10A device rotated 90 degrees counterclockwise.

There are numerous alternate embodiments of this invention included with FIG. 5B, FIGS. 6A through 6C, FIG. 7, FIGS. 8A and B, and FIGS. 10A and B. In these alternatives, elements common to the device of FIGS. 1 through 5A are commonly numbered though in the next hundred series.

Figure 5B:
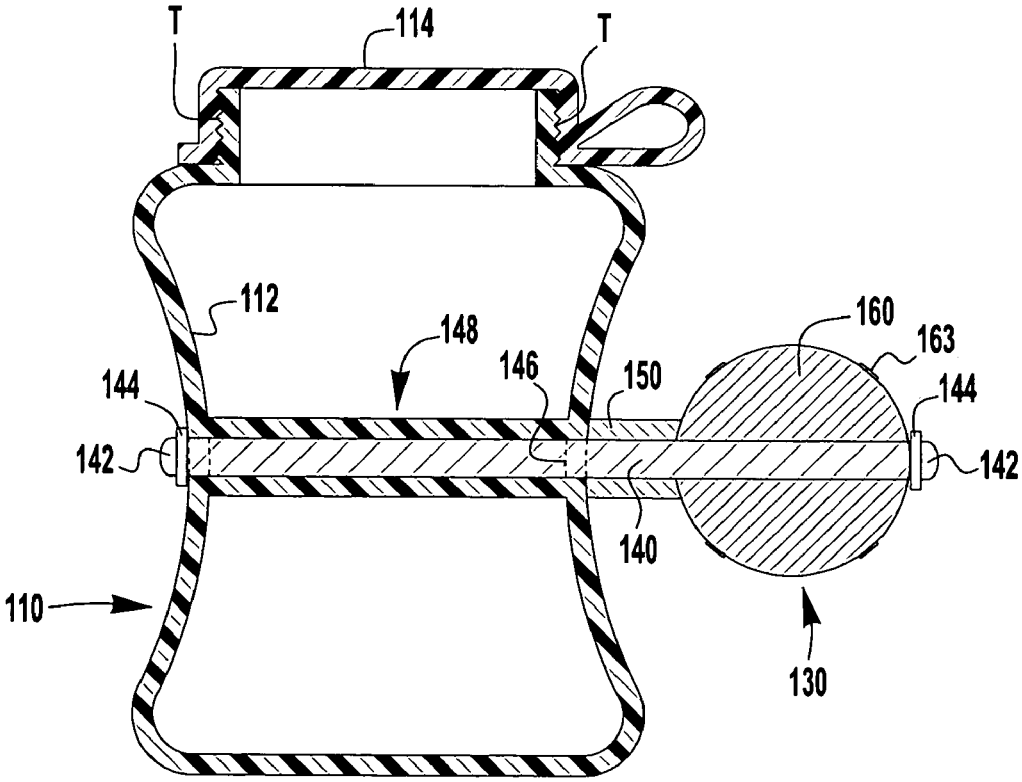
FIG. 5B is a left side, cross-sectional view of the alternate device with an integrally formed ball mounting means.

Referring to FIG. 5B, there is shown an alternate embodiment of device 110, with its body component 112 and cap or lid 114. The FIG. 5B embodiment differs from its FIG. 5A counterpart in that the body component for same is molded to include a unitized or integral sleeve element 148. It is through that pre-formed channel that a duly sized bolt 140, with its bolt head 142 and washer 144 are threaded before passing out through: its opposite wall hole 146, a spacer element 150, ball (or gripping element 160) with stitches 163, another washer 144 and final bolt head 142. With this configuration having a predisposed channel through which ball mounting bolts may pass, it is much simpler to employ said devices for drinkable liquid carrying during and after exercising. There is no risk of leakage or jostling of device contents that might impact on internal gasket/seal/washer integrity.

Figure 6A:
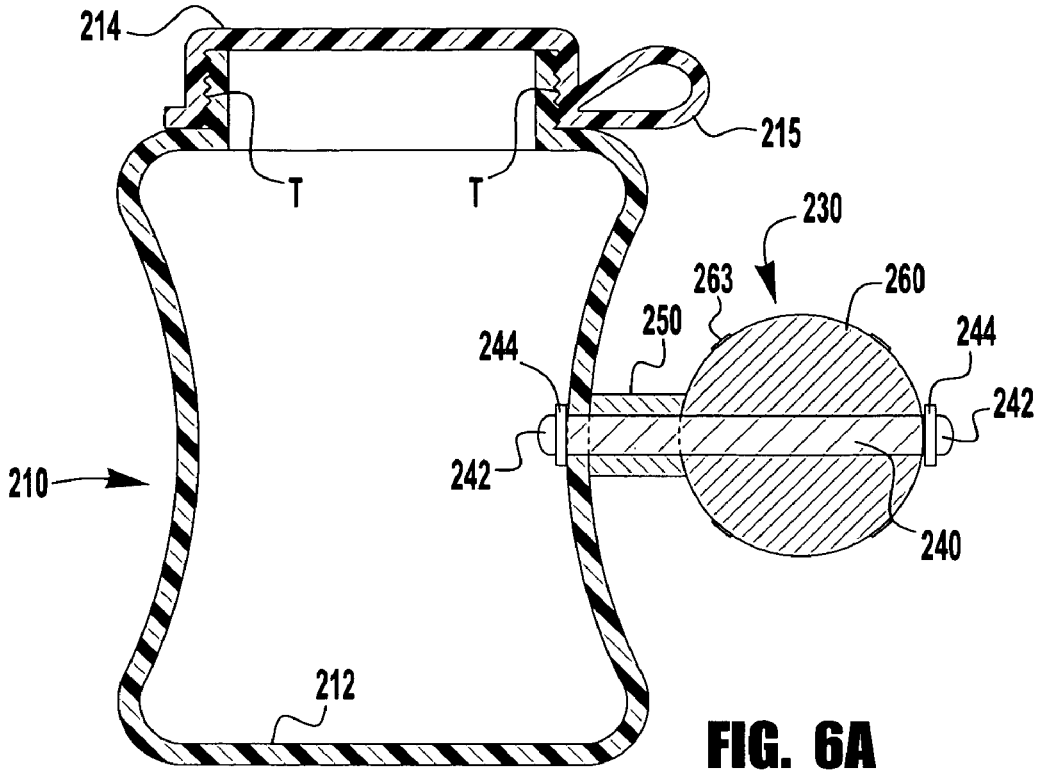
FIG. 6A is a left side, cross-sectional view of a second alternate embodiment with ball mounting means from only one bottle sidewall.

In FIG. 6A, there is shown another alternate device 210, with its body component 212 and lid or cap component 214. In this cross-sectional view, gripping element 230 fixedly attaches to and through only one sidewall of body component 212. Such mounting uses a shorter length of bolt 240, with its bolt head 242 passing through first washer 244, metal spacer element 250 and ball grip 260 (with stitches 263) before terminating with a washer 244 and opposite bolt head 242.

Figure 6B:
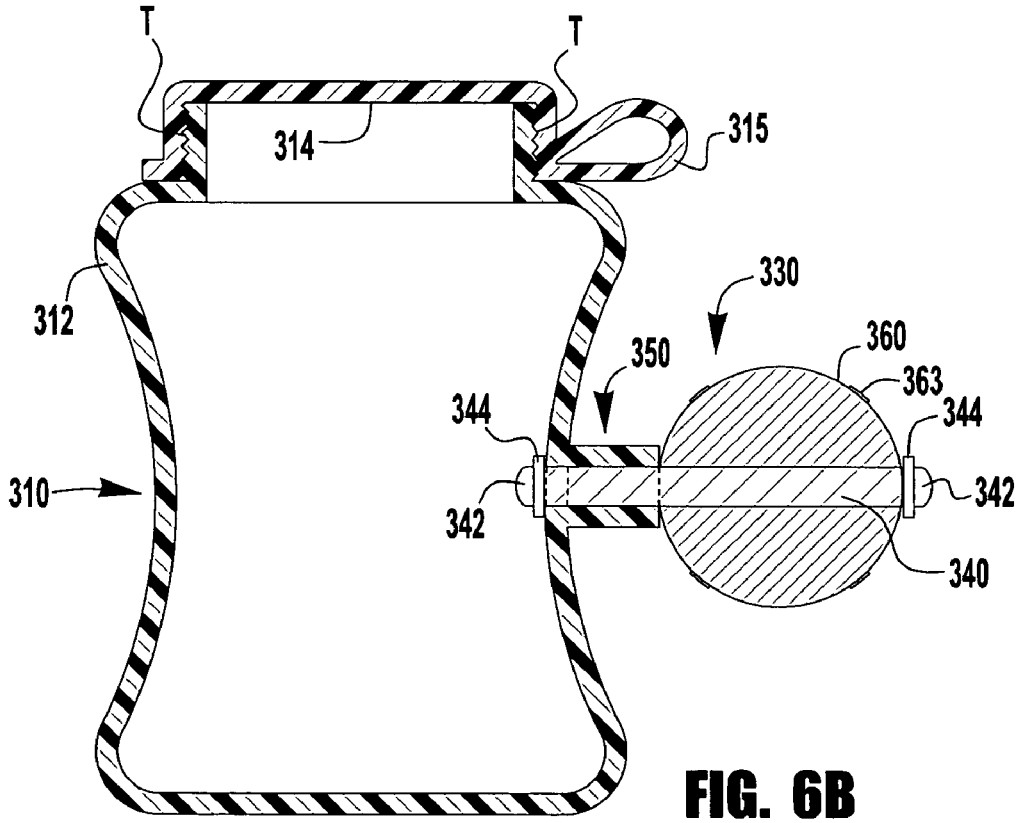
FIG. 6B is a left side, cross-sectional view of a third alternate embodiment to FIG. 6A wherein the one sidewall ball mounting means is integrally formed.

The alternate embodiment in FIG. 6B is more like the two walled connection of FIG. 5B. In particular, device 310 of this embodiment has a body component 312 with an integrally formed spacer/shaft 350 through which the gripping mechanism of a bolt 340, with bolt head 342, washer 344 and ball grip 360 (with stitches 363) are mounted before terminating in the second washer 344 and bolt head 342 at the opposed end.

Figure 6C:
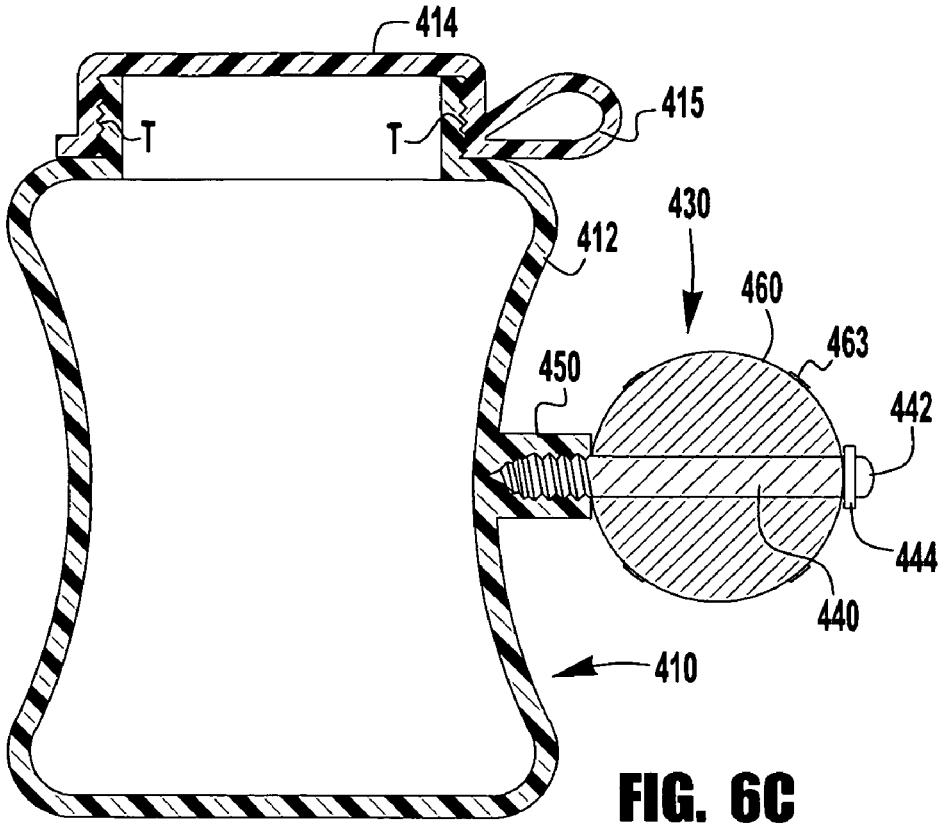
FIG. 6C is a left side, cross-sectional view of a fourth alternative embodiment, similar to FIG. 6B, but with a ball mounting means that does not pass through any bottle sidewall.

In the additional variation at FIG. 6C, the molded (or integrally formed) stem 450 butting out from the midway point to one sidewall of the body component 412 to device 410 has no apertures for bolting through. Instead, it includes a screw tipped attachment 440 with one end that permanently affixes into an integrally formed, molded stem 450. In some instances, additional adherence is achieved by applying glues and/or other epoxies to the varying components. The ball 460 with stitches 463 would extend outwardly from that integral stem unit 450.

Figure 7:
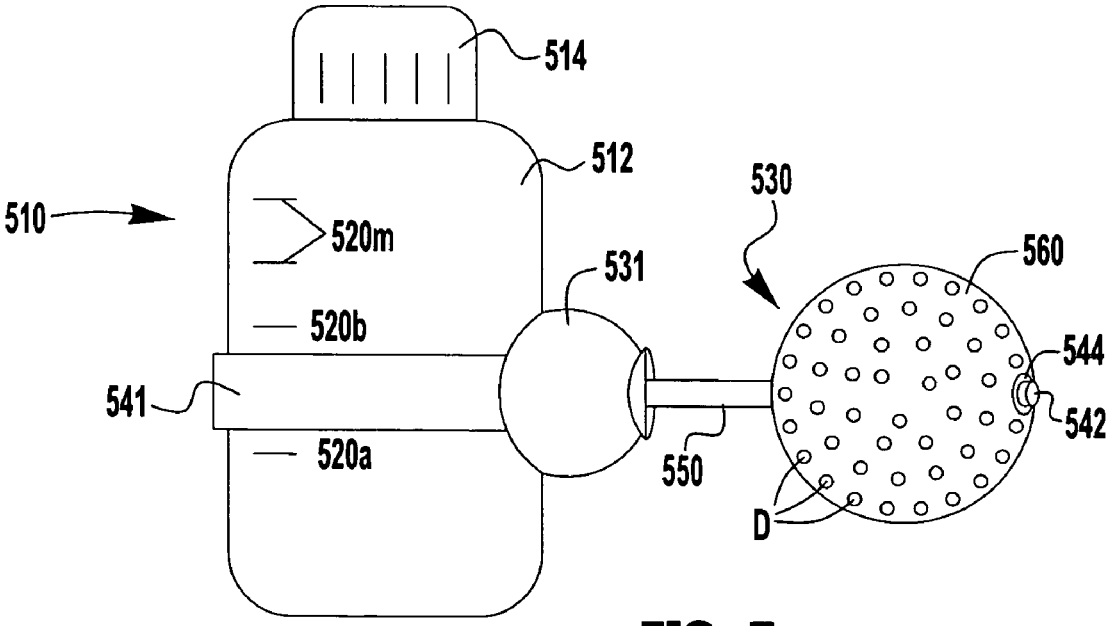
FIG. 7 is a left side plan view of a fifth alternate embodiment wherein a practice ball mounting means is affixed around the bottle exterior.

Yet another embodiment of this invention is shown in FIG. 7. In that version of device 510, with its body component 512 and lid or cap component 514, the means for mounting gripping element 530 is not affixed through but only onto (or, more specifically around) the circumference of body component 512 with a tightened band or strap 541. With bolts, glues and/or a plurality of staples (not shown), the base 531 to gripping element 530 affixes to this band/strap 541. Then following, in succession, is a first washer 544, elongate spacer 550, ball grip 560 before terminating in a second washer 544 and bolt head 542.

Also in FIG. 7, a standard baseball grip has been replaced by a representative alternative. Therein, a rubber or polymer-based, practice ball substantially similar in size, shape and weight to that of a typical baseball is used. That baseball-sized grip 560 includes a plurality of dimples or perforates D for better gripping during exercises. When a rubberized alternative is used, it is not necessary for that ball to employ real or simulated stitching. On a rubberized surface, artificial stitching might even lead to slippage or early release of the device 510 when performing certain exercise routines therewith.

Figure 8A:
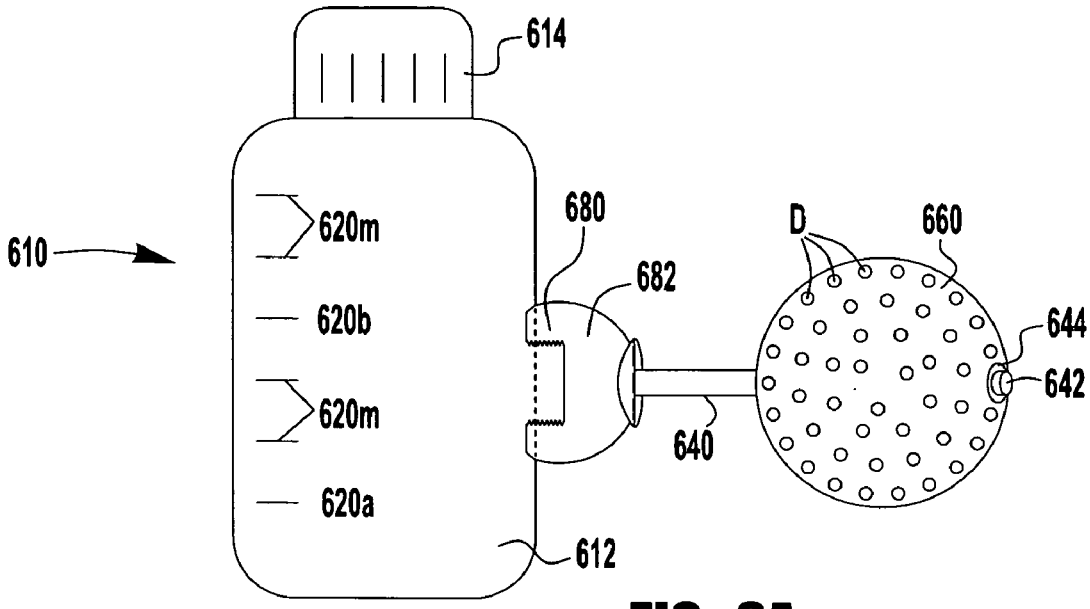
FIG. 8A is a left side plan view of a sixth alternate embodiment with an interchangeable device exercise mount.
Figure 8B:
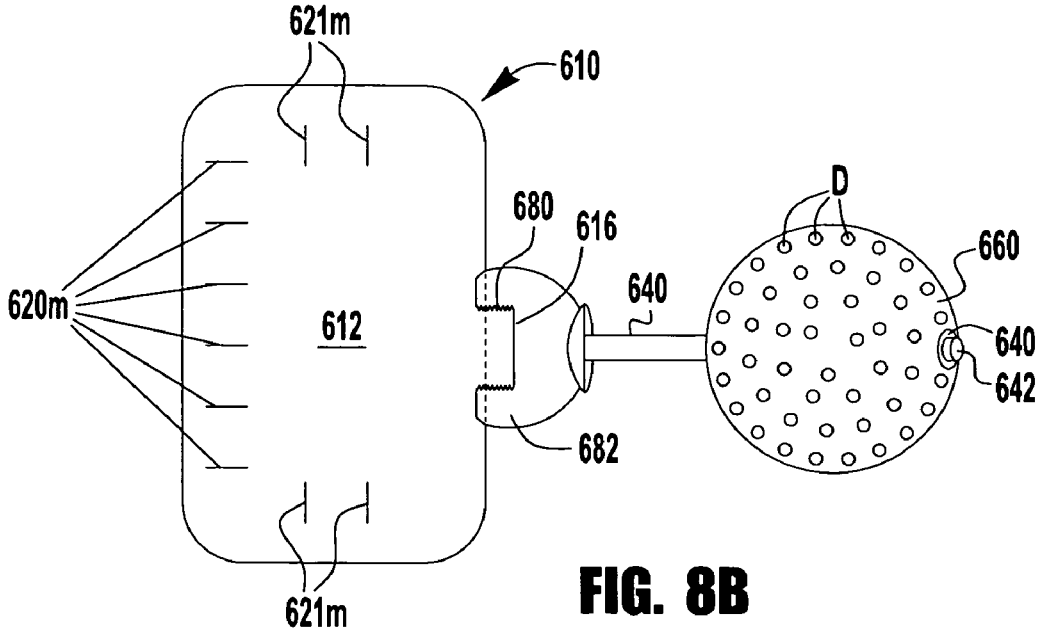
FIG. 8B is a left side plan view of a seventh alternate embodiment, similar to that of FIG. 8A but with no separate lidding element.

In FIGS. 8A and 8B, the same sort of interchangeable gripping element hinted at in FIG. 7 is shown in more detail. For these two embodiment counterparts, device 610 has a body component 612 with only the first version in FIG. 8A having a separate and distinct cap component 614. The version shown in FIG. 8B has only one main aperture 616 through which liquids may be added or removed. That aperture extends at or about the midpoint to a sidewall of body component 612. Needless to say, such positioning would make beverage drinking through any lid screwed onto or over that aperture awkward if not impossible. As such, a sidewall component configuration like that depicted in FIG. 8B would be for non-thirst quenching applications like those anticipated hereby and shown and described herein.

With the implementation of a side only fill means, the device 610 of FIG. 8B may need to include a second set of markings, the first set 620*m* being visible and useable when the bottle device is rested on either its flat top or bottom. A second set of markings 621*m* would need to be added for showing preferred liquid fill levels when the device 610 is on its side and said aperture is laid open for adding liquid elements therein.

In both the lidded (FIG. 8A) and non-lidded (FIG. 8B) versions, both alternative devices employ a similar means of interchangeable, exercising sports grips, or gripping elements 630. For both variations, the gripping element 630 is only meant to temporarily extend outward from a sidewall of body component 612. For greater versatility between sports, the sidewall for these embodiments includes a special threaded region 680. For the version at FIG. 8A, that region of device 610 need not require a liquid tight seal in as much as no liquid media is ever intended to pass through said configuration. Further components include a gripper adapter base 682 with internal threads corresponding to those of threaded region 680. In yet another alternative, not shown, base 682 may be sufficiently sized to eliminate the need for a separate, stand alone spacer element (the equivalent of earlier element 50). Instead, this alternative could be directly served with an elongate bolt 640 that passes through ball grip 660 and washer 644, before terminating with ball grip bolt head 642.

Figure 9A:
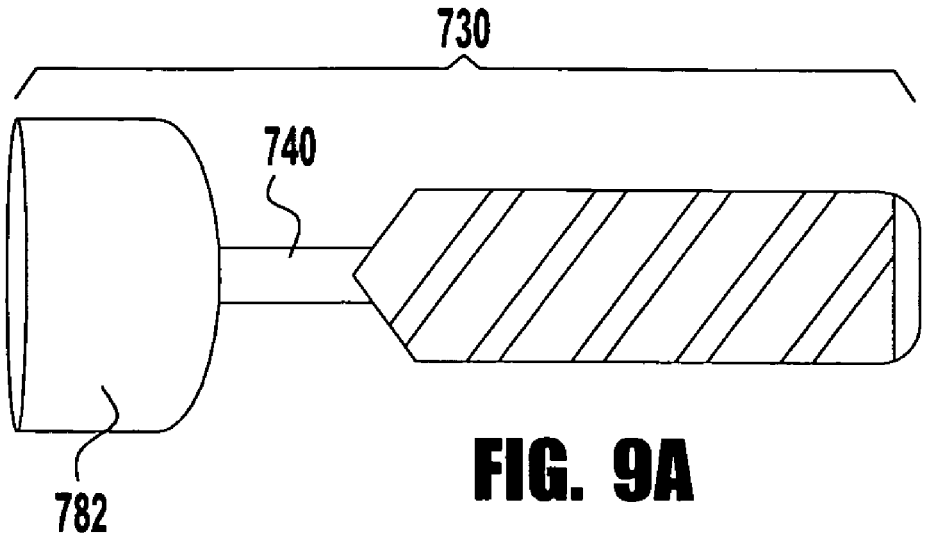
FIG. 9A is a top plan view of an alternative racket handle exercise mount for the device of either FIG. 8A or 8B.

In FIGS. 9A and B, alternate shapes of gripper exerciser are shown as a variation from the gripper adapter base 682 in prior FIGS. 8A and B. Particularly, FIG. 9A shows a gripper exerciser, generally 730, whose shape resembles a racket handle 762 at one end, a screw-on base 782 at the opposite end and a bolt element 740 extending there between. Possibly, a portion of bolt element 740 extends partially into, or even through one or both end components. Though shown as a typical tennis racket handle, it is understood that still other configurations may include a badminton or racquetball racket handle shapes.

Figure 9B:
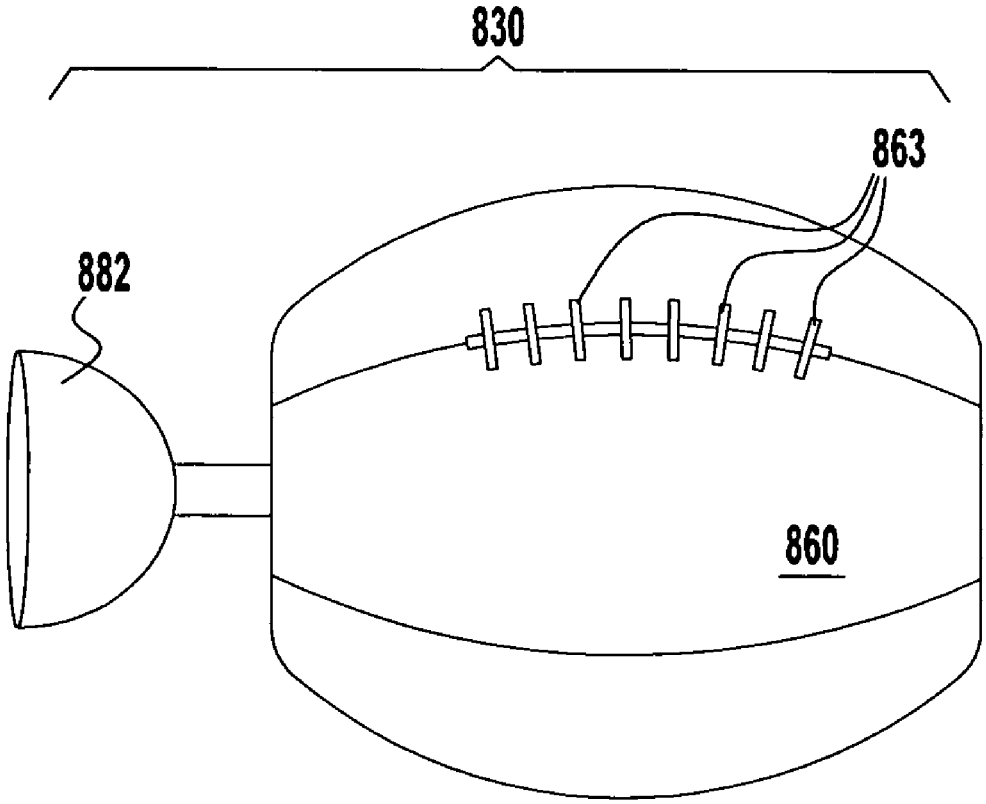
FIG. 9B is a top plan view of an alternative football handle exercise mount for the device of either FIG. 8A or 8B.

In FIG. 9B, yet another alternate gripper shape 830 is shown extending from its own gripper adapter base 882. Therein, that exerciser shape resembles a section of regulation size football 860 (with ball tip ends removed). The ball tip ends are unnecessary for using such a device for practicing ball throwing exercises, i.e. warm ups and the like. It is important that this alternative shape include real or simulated stitches/laces 863 as such stitches are critical for the proper gripping and throwing of any football.

In one additional embodiment shown in FIGS. 10A and B, the device 910 has a body component 912 with a lower end, nearest its base, that has an inward and upwardly beveling region 913 before eventually joining up to lid/cap component 914. More notably, the remainder of the lowermost shape to beveling region 913 includes several simulated stitches/laces 963 on opposed sidewalls to body component 912. They allow for exercising with the lowermost end to device 912 for one sport (football) without having to unnecessarily disengage the ball gripping region 930 more commonly used for baseball pitching warm-ups.

An advantage of this invention is that the device does not require anyone other than the athlete to use. The device need not be tethered, anchored or fixed to any grounding structure. It is wholly hand-held, easily portable and useable either indoors or outdoors. On a pitching mound, the device allows an athlete to train under the same conditions as would be experienced in a game, thereby maximizing the development of muscular strength and coordination at "game speed". The device remains in the athlete's hand during use thereby allowing a fast-paced, repetitive oscillating workout uninterrupted by having to stop for repeated thrown ball retrievals. Indoors, an athlete may use the device before a mirror or other reflective surface for better evaluating and rapidly correcting flaws in pitching technique.

The device can be used to warm-up an athlete's throwing arm and/or rehabilitate it with moderate effort. An athlete using this device can generate less acceleration on various elements of his/her muscular-skeletal structure to produce a lower impact workout, including one with a gradual, more benign deceleration than is typical in pitching a baseball. As such, use of this device should minimize or completely eliminate those shoulder and arm injuries normally associated with rapid deceleration by a fatigued athlete.

Figure 11A:
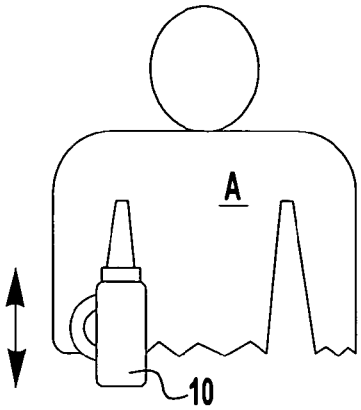
FIGS. 11A and B are diagrammatic front and side views of an athlete using the device to exercise with his arm bent at the elbow and at waist height with an arrow indicating a first up and down direction of oscillation.
Figure 11B:
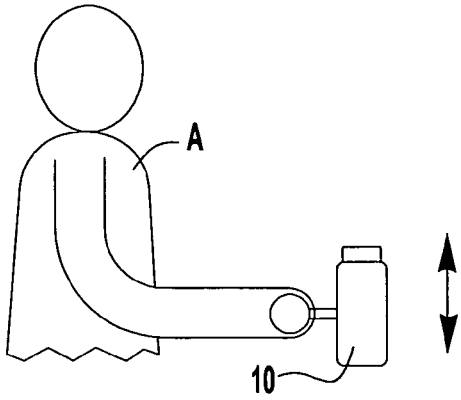
FIGS. 11C and D are diagrammatic front and side views of an athlete using the device in the same exercise position as FIGS. 11A and B, but with an arrow indicating a side-to-side direction of oscillation.
FIGS. 11E and F are diagrammatic front and side views of an athlete using the device to exercise with his extended arm facing front at shoulder height, the arrow indicating a direction of oscillation for same.
FIGS. 11G, H and I are diagrammatic front (11G) and side views (11H and I) of an athlete using the device to exercise with his extended arm straight up in the air with the arrows indicating a fixed arm, elbow exercising direction of oscillation for FIG. 11H and a fuller shoulder exercise with the whole arm moving per the side view arrow indicator at FIG. 11I.

In the remaining FIGURES, there are shown numerous exercises for an athlete using the device of this invention. FIGS. 11A and B, for example, show an athlete A shown with his arm bent at the elbow and at waist height. Device 10 is gripped by the athlete's right hand and shaken up and down in the direction of the arrows in this front and side view for an effective, warm up oscillating exercise. One preferred timing for this particular exercise extends between about 30 seconds to 1 minute per hand.

Figure 11C:
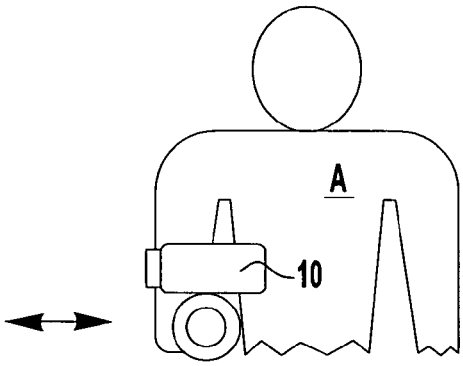
Figure 11D:
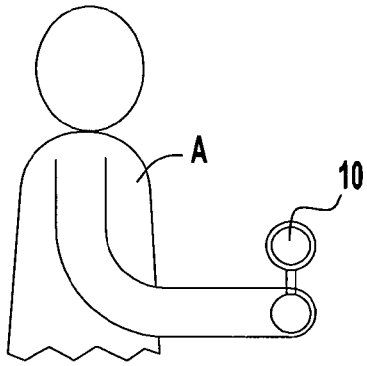
Figure 11E:
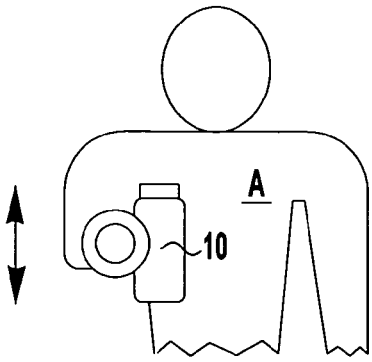
Figure 11F:
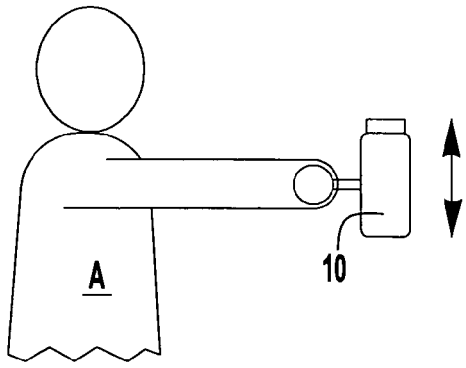

In FIGS. 11C and D, the same general exercise as above is repeated but with device 10 rotated 90 degrees for repeated, oscillating movements from side-to-side. FIGS. 11E and F show a third exercise with device 10. In this version, athlete A shakes or oscillates the device up and down (as shown by the arrows) but with his/her arm fully extended outwardly and substantially parallel to the shoulder.

Figure 11G:
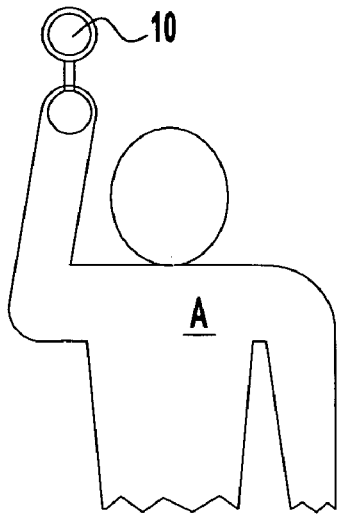
Figure 11H:
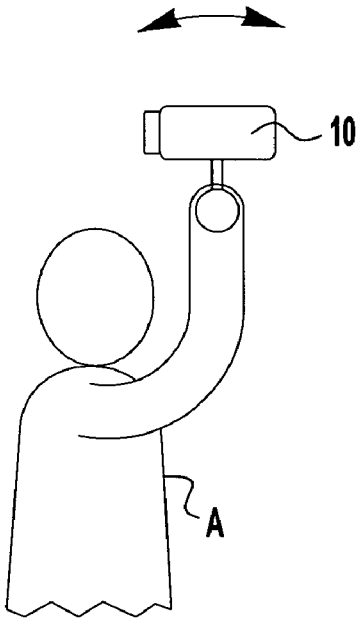
Figure 11I:
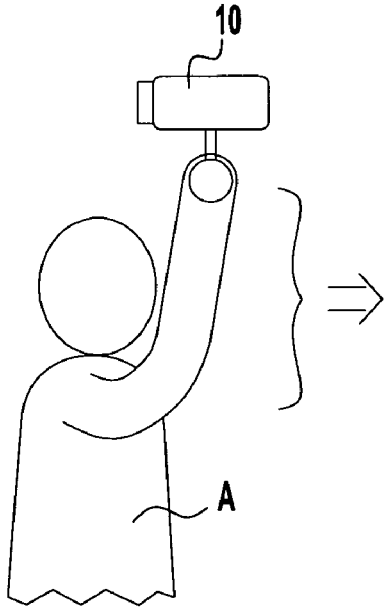

Finally, FIGS. 11G, H and I include a front (11G) and side views of athlete A with his/her arm fully raised. A first set of exercises in this position oscillates the device 10 back and forth, in the direction of the arrow at the top of FIG. 11H, but with the athlete's elbow fixed in one position. Contrast that with a second set of extended arm exercises shown in FIG. 11I. Therein, the athlete's whole elbow and lower arm are moved back and forth, in the direction of the larger, lower arrow, midway through the right side of FIG. 11I.

Figure 12A:
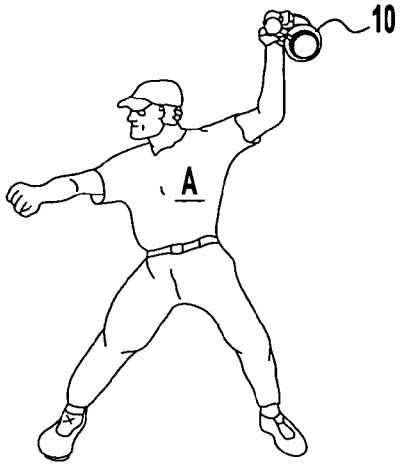
FIGS. 12A through D are diagrammatic perspective views of an athlete using the inventive device, showing various phases of a complete pitching motion which are, in order: the ready-position (12A), stride (12B), delivery (12C) and follow-through (12D).
Figure 12B:
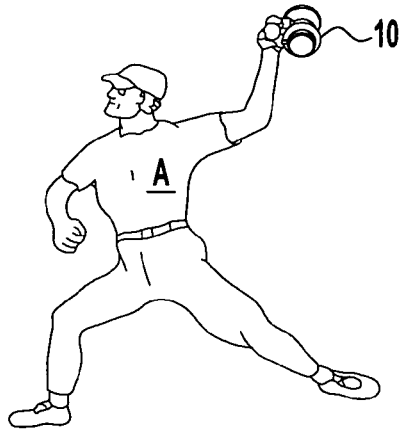
Figure 12C:
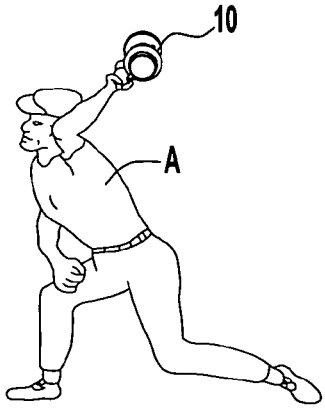
Figure 12D:
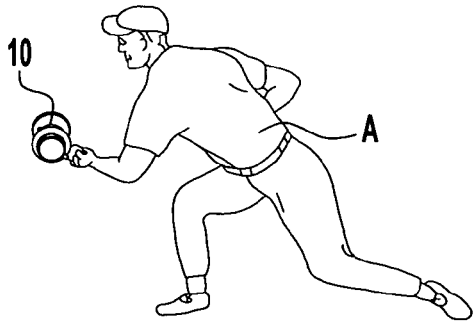

Referring now to FIGS. 12A, B, C and D, there is shown an athlete A using a device 10 while simulating the four distinct phases of a pitcher's throwing motion. In FIG. 12A, the athlete holds device at the beginning of a typical pitch delivery. The athlete's throwing arm is in the high cocked position, motionless, but ready to explode forward. FIG. 12B shows the athlete striding forward with the velocity of his/her throwing hand increasing but not at full velocity. In FIG. 12C, the point of maximum velocity in a pitch delivery is reached. Finally, FIG. 12D illustrates the follow-through phase of a typical throwing motion with its gradual deceleration of the athlete's muscular-skeletal structure.

It is understood that the training and strengthening device of this invention can be employed for other training uses including throwing a football, a softball and/or serving a tennis ball. In some cases, alternative uses of the device may necessitate, or result in, changes to the embodiments described above. But all such changes are considered to be still within the scope of the present invention.

What is claimed is:

1. An exercise device for an athlete to exercise his shoulder or arm by simulating a throwing or swinging motion, said device being wholly held by the athlete with one hand and comprising:

(a) a bottle having a non-breakable main body for holding varying amounts of a media inserted into the main body, and a lid component; and (b) a gripping element extending a spaced distance from a side of the main body of the bottle, said gripping element having a ball or handle configuration that the athlete holds onto for simulating throwing or swinging with the exercise device wherein the gripping element is attached through opposed sides of the main body of the bottle and wherein the gripping element is selected from the group consisting of: a regulation size baseball, a regulation size softball, a practice baseball or softball, a racket handle and at least a portion of a regulation size football.

2. The exercise device of claim 1, wherein the main body of the bottle includes at least one semi-transparent section with markings for indicating the amount of media inside.

3. The exercise device of claim 1, wherein the main body of the bottle is substantially concave in cross-section.

4. The exercise device of claim 1, wherein the gripping element is fixedly attached to a side of the main body of the bottle.

5. The exercise device of claim 1, wherein the gripping element is temporarily attached to the main body of the bottle and adapted for interchangeability with other gripping elements.

6. The exercise device of claim 1, wherein the gripping element extends from an intermediate point along one side of the main body of the bottle.

7. The exercise device of claim 1, wherein the media in the bottle is a drinkable liquid.

8. The exercise device of claim 1 which further includes one or more of: a clock timer and a cap carrying loop.

9. A device with which an athlete may perform various shoulder and arm exercises, said device:

(a) a bottle having a lid component and a substantially semi-transparent, plastic main body for holding varying amounts of a liquid media, said main body including a plurality of side markings for indicating the amount to liquid media in said body for the athlete to perform various exercises therewith; and (b) a gripping element for the athlete to hold onto when performing exercises with the device, said gripping element extending a spaced distance from and substantially intermediate one sidewall of the main body of the bottle and wherein the gripping element is attached through opposed sides of the main body of the bottle and wherein the gripping element is selected from the group consisting of: a regulation size baseball, a regulation size softball, a practice baseball or softball, a racket handle and at least a portion of a regulation size football.

10. The device of claim 9, wherein the main body of the bottle is substantially concave in cross-section.

11. The device of claim 9, wherein the gripping element is fixedly attached through at least one sidewall of the main body of the bottle.

12. The device of claim 9, wherein the gripping element is temporarily attached to the main body of the bottle and adapted for interchangeability with other gripping elements.

13. The device of claim 9 which further includes a clock timer.

* * * * *